United States Patent [19]

Dubery et al.

[11] 4,032,037

[45] June 28, 1977

[54] CLOSURE AND FASTENER FOR TRASH BINS

[75] Inventors: Roy Frederick Dubery, Hanworth; Ronald Arther Chivrall, London, both of England

[73] Assignee: Airfix Plastics Limited, Hanworth, England

[22] Filed: Apr. 7, 1976

[21] Appl. No.: 674,403

[30] Foreign Application Priority Data

Mar. 6, 1976 United Kingdom .....09090/76

[52] U.S. Cl. ..... 220/335; 220/1 T

[51] Int. Cl.[2] ..... B65D 43/24

[58] Field of Search ..... 220/1 T, 263, 264, 334, 220/335

[56] References Cited

UNITED STATES PATENTS

| | | | |
|---|---|---|---|
| 3,203,575 | 8/1965 | Anderson et al. | 220/335 |
| 3,749,274 | 7/1973 | Mele et al. | 220/1 T |

*Primary Examiner*—George T. Hall

*Attorney, Agent, or Firm*—Marshall & Yeasting

[57] ABSTRACT

The invention provides a bin for household waste having a lid which is counterweighted or spring urged so as to be normally held in a closed position, and with catch means arranged so as to engage the lid when it is swung to an open position and hold the lid in the open position; release means are provided to disengage the catch means and allow the lid to swing to the closed position again.

4 Claims, 4 Drawing Figures

CLOSURE AND FASTENER FOR TRASH BINS

SUMMARY OF THE INVENTION

This invention relates to bins for receiving waste, for example for domestic use.

In accordance with the invention a bin comprises a lid arranged to open or close an aperture affording access to the bin interior, said lid being hinged for movement between the open and closed positions, means for moving the lid to and holding it in the closed position, catch means for holding the lid in the open position when moved thereto, and release means for disengaging the catch to allow reclosing.

Preferably the lid is provided in a surface which is inclined to the horizontal, the lid being co-planar with said surface when in the closed position, and the lid is hinged about its upper edge. Preferably also the lid is disposed in at least a generally vertical position when fully open, and possibly in a position inclined rearwardly from the vertical position.

The catch means may comprise a magnet and a metal keeper therefore, and conveniently the magnet is mounted on the underside of the structure to which the lid is hinged, and the metal keeper is provided on an extension of the lid. In accordance with an important feature of the invention, the keeper is free for limited movement relative to the lid, to enable it to conform into face-to-face abutting contact with the magnet when the lid is in an open position. This enables relatively cheap material strip to be used for the keeper, and a quite small magnet to be used yet which will hold the lid in the fully open position. If the keeper were not free for at least a limited movement, the keeper and magnet would have to be located with precision, in order to ensure the face-to-face contact, or alternatively a much larger magnet would be necessary to hold the lid in the open position.

Further, the metal keeper is preferably arranged to act as a counterweight to restore the lid to the closed position as soon as the keeper is disengaged from the magnet. To this end, the release means may comprise a plunger arranged to displace the lid for a short distance to disengage the magnet and the keeper.

DESCRIPTION OF THE PREFERRED EMBODIMENTS

Figure 2:
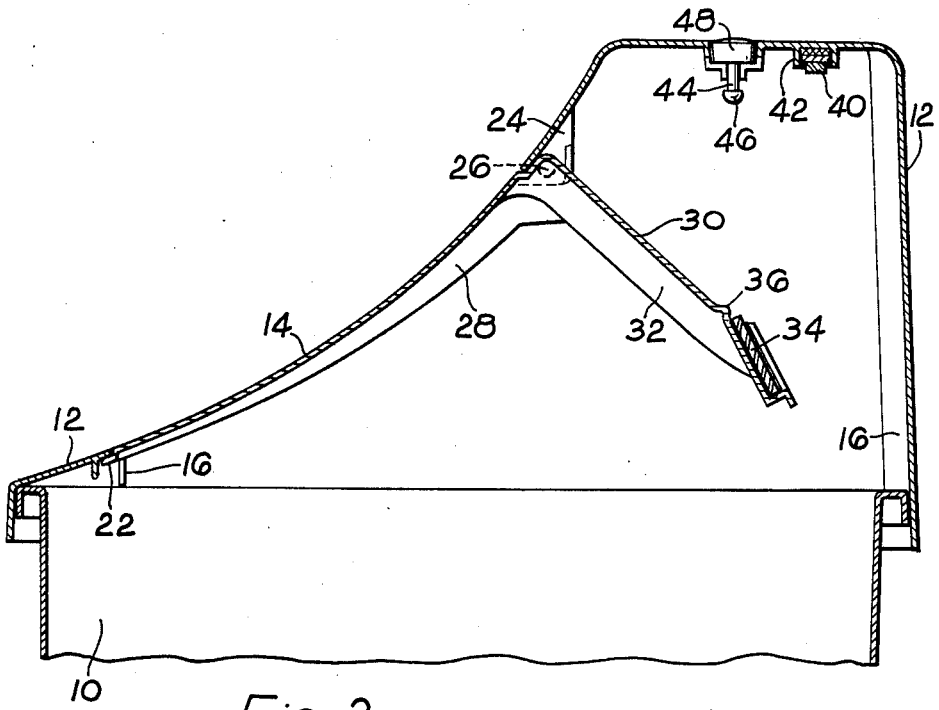
FIG. 2 is a sectional elevation showing the lid in the closed position.

Referring now to the drawings, the bin comprises a container 10, a top 12 and a lid 14. The top merely rests on the upper edge of the container 10 as best seen in FIG. 2, with internal strengthening webs 16 contacting the top face or rim of the container to hold the parts in the illustrated position. It is thus a simple matter to lift off the top structure when it is desired to empty the bin for example to cleanse the interior.

Figure 1:
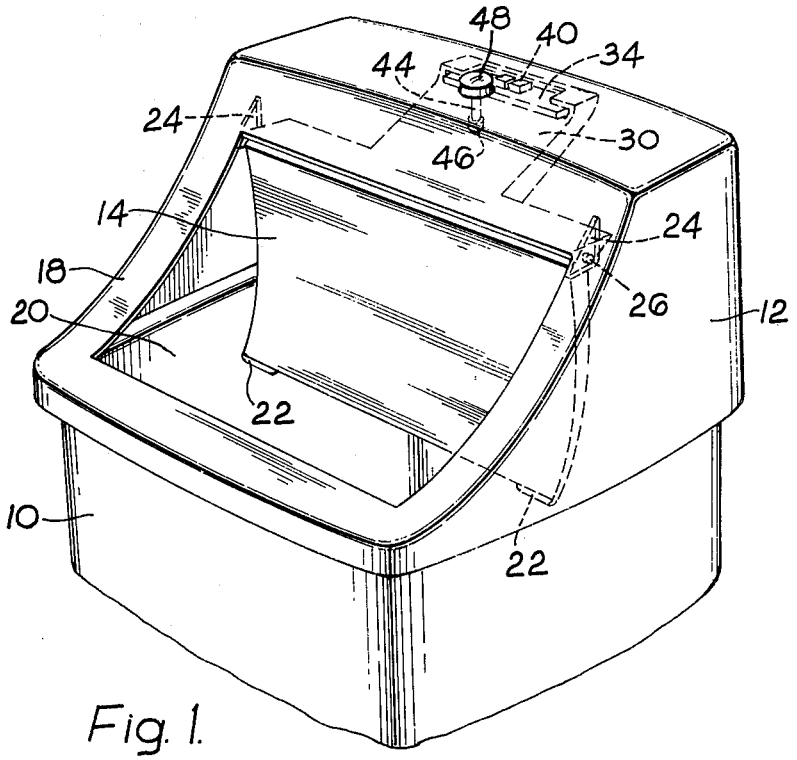
FIG. 1 is a perspective and somewhat diagrammtic view of the upper portion of a domestic waste bin showing a lid of the same in open position.

The top structure comprises an inclined upper surface 18 which is apertured to receive the lid. The aperture is relatively large to facilitate ingress of waste material in ordinary domestic use. the lid is arranged to fill the aperture 14 and has a pair of projecting lugs 22 which contact the surface 18 on the interior, see especially FIG. 2 to limit movement of the lid from the open position illustrated in FIG. 1 and prevent it going past the closed position illustrated in FIG. 2.

The interior of the top structure is provided with a pair of generally triangular lugs 24 which are co-axially apertured, and the lid is provided with a pair of co-axial trunnion pins 26 which can be snap-engaged in the apertures in the said lugs after deflection of one or other of the same.

The lateral edges of the lid are provided with strengthening flanges 28 and on the opposite side of the axis afforded by pins 26 to that of the lid proper 14, a lever arm 30 is provided. This has lateral flanges 32 for stiffening purposes, and conveniently the arm is generally at right angles to the lid proper.

Figure 3:
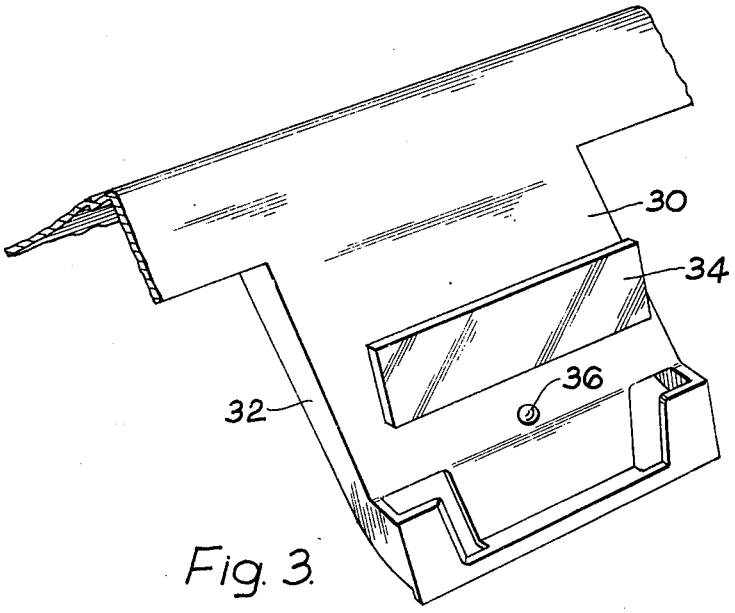
FIG. 3 is a fragmentary perspective view showing a portion of the lid.

The free end of the arm 30 remote from the pivot axis is provided with a pocket which receives a strip of mild steel 34 forming a keeper plate. The pocket is open over its central area to reveal the keeper and for contact of the magnet (as hereinafter explained) with the keeper as best seen in FIG. 3. Assuming that the parts are to be made as injection mouldings of plastics materials, as is preferred, the arm 30 may be provided with a projection 36 which is arranged so that in assembly of the keeper plate, the latter can be pushed into the pocket to deform or deflect the projection 36, the latter snap-engaging behind the keeper plate when the latter is received in the pocket.

It is to be noted that the metal strip 34 is slightly shorter than the length of the pocket, thinner than the width of the pocket and narrower than the breadth of the pocket, so that in fact it is free for movement in all of three directions mutually at right angles.

Permanent magnet 40 is located in a housing 42 on the underside of the top structure, being held in position e.g. by suitable adhesive between the magnet and the top. The magnet is positioned so as to contact the keeper plate when the lid is swung to the FIG. 1 position.

Adjacent the catch afforded by the magnet is a release member in the form of plunger 44 having an enlarged head 46 at its lower end and button 48 at its upper end. The wall of the top structure is radially slit in the vicinity of the plunger so as to enable the plunger to be assembled to the top structure by deformation and subsequent snap-engagement of the plastics material, so as to secure the release button assembly to the top structure. The spacing between the button and the head 46 is greater than the length of the sleeve provided in the plastics material and through which the plunger stem extends, and the geometry is such that when the lid is swung to the FIG. 1 position the head 46 contacts the arm 30 and the plunger is moved axially so that the button 48 stands proud of the exterior of the top structure.

Pressing the button 48 to restore it to a flush condition displaces the arm 30 sufficiently to disengage the keeper from the magnet, and the keeper then acts as a counterweight to restore the lid to the FIG. 2 position. Hence the lid remains closed by gravity.

Figure 4:
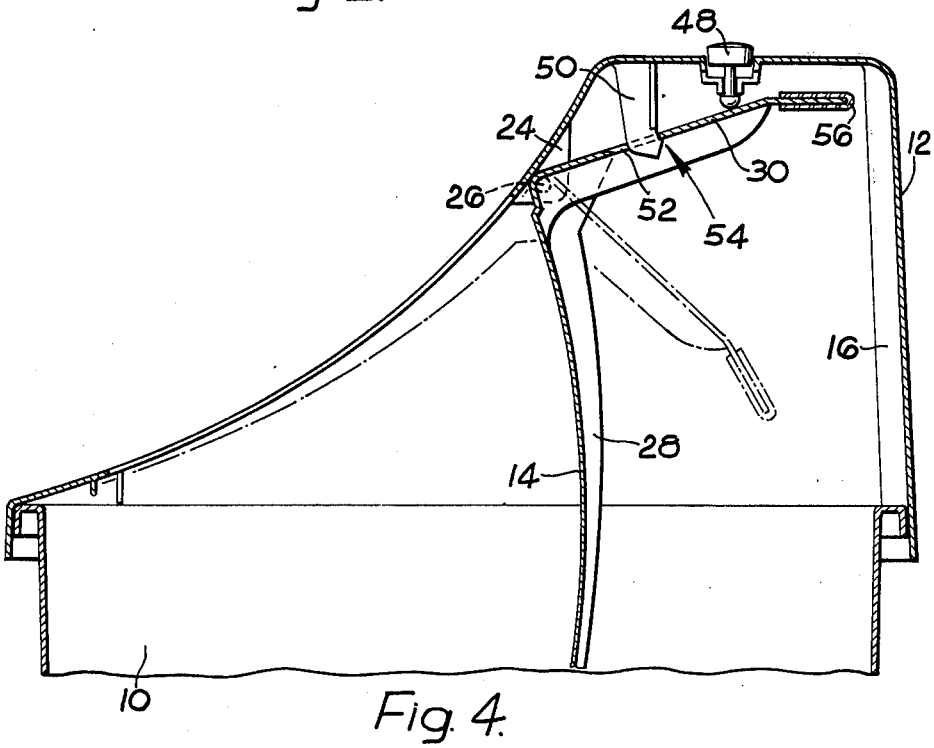
FIG. 4 is a view generally similar to FIG. 2 but showing a modification, in full lines in the open position and in chain-dot lines in the closed position.

The arrangement shown in FIG. 4 differs in that a prong 50 is provided on the interior of the top structure and the lever arm 30 is provided with slot 52 through which the prong extends when the lid is moved to the open position as illustrated. The prong has a lateral projection 54 which engages behind the lever arm to hold the lid in the FIG. 4 position, until depression of the button 48 snaps the lever arm past the projection to allow counterweight 56 (which may be in slightly different form to the combination magnet keeper and counterweight 34 of FIGS. 1 to 3) to return the lid to the chain-dot line position shown in the FIGURE.

In another modification (not shown) the catch for holding the lid open comprises an area of adhesive material arranged to be contacted by the lid when swung to the open position. The adhesive material needs to be capable of being repeatedly reused without loosing its powers of adhesion, or possibly is arranged to be readily replaced as and when required.

In another modification (also not shown) the means for closing the lid comprise a spring.

What we claim is:

1. A bin comprising an aperture affording access to the bin interior, and a lid hinged to the bin for movement between an open position and a position closing said aperture, the lid being movable by gravity to closed position, wherein the improvement comprises a catch consisting of a magnet mounted on the bin, and a keeper carried in a pocket in the lid in a position to engage said magnet when the lid is in open position, the keeper being free to move in the pocket to a limited extent to enable it to conform to the opposing face of the magnet, and release means for disengaging the keeper from the magnet to allow the lid to close.

2. A bin according to claim 1, wherein the release means comprises a plunger for displacing the lid far enough toward closed position to disengage the catch.

3. A bin comprising an aperture affording access to the bin interior, and a lid hinged to the bin for movement between an open position and a position closing said aperture, the lid being movable by gravity to closed position, wherein the improvement comprises a catch consisting of a prong and a slot, one located on the bin and the other located on the lid, said prong and slot being engaged when the lid is in open position, and said prong having an offset portion which snaps past one end of said slot when the prong enters the slot, and release means for disengaging the prong from the slot to allow the lid to close.

4. A bin according to claim 3, wherein the release means comprises a plunger for displacing the lid far enough toward closed position to disengage the catch.

* * * * *